US010841989B2

(12) United States Patent
Gordon et al.

(10) Patent No.: US 10,841,989 B2
(45) Date of Patent: Nov. 17, 2020

(54) GASEOUS-PHASE IONIZING RADIATION GENERATOR

(71) Applicants: Frank E Gordon, San Diego, CA (US); Harper John Whitehouse, San Diego, CA (US)

(72) Inventors: Frank E Gordon, San Diego, CA (US); Harper John Whitehouse, San Diego, CA (US)

(73) Assignee: Inovl, Inc., San Diego, CA (US)

( * ) Notice: Subject to any disclaimer, the term of this patent is extended or adjusted under 35 U.S.C. 154(b) by 0 days.

(21) Appl. No.: 16/548,566

(22) Filed: Aug. 22, 2019

(65) Prior Publication Data

US 2020/0068690 A1 Feb. 27, 2020

Related U.S. Application Data

(60) Provisional application No. 62/721,472, filed on Aug. 22, 2018.

(51) Int. Cl.

| | |
|---|---|
| ***H05B 41/36*** | (2006.01) |
| ***H01J 61/28*** | (2006.01) |
| ***H01J 61/06*** | (2006.01) |
| ***H01J 61/12*** | (2006.01) |
| ***H01J 9/02*** | (2006.01) |
| ***H01J 61/52*** | (2006.01) |
| ***H01J 61/42*** | (2006.01) |
| ***H01J 9/395*** | (2006.01) |
| ***H01J 61/36*** | (2006.01) |

(52) U.S. Cl.

CPC ..... *H05B 41/36* (2013.01); *H01J 9/02* (2013.01); *H01J 9/395* (2013.01); *H01J 61/06* (2013.01); *H01J 61/12* (2013.01); *H01J 61/28* (2013.01); *H01J 61/36* (2013.01); *H01J 61/42* (2013.01); *H01J 61/526* (2013.01)

(58) Field of Classification Search

None

See application file for complete search history.

(56) References Cited

U.S. PATENT DOCUMENTS

| | | | | |
|---|---|---|---|---|
| 7,663,053 | B2 * | 2/2010 | Zuppero | H01L 29/66 136/205 |
| 8,378,207 | B2 * | 2/2013 | Zuppero | H01L 29/66 136/205 |
| 8,419,919 | B1 * | 4/2013 | Boss | C25C 5/02 205/220 |

(Continued)

*Primary Examiner* — Amy Cohen Johnson
*Assistant Examiner* — Srinivas Sathiraju
(74) *Attorney, Agent, or Firm* — Morland C. Fischer

(57) ABSTRACT

A gaseous-phase ionizing radiation generator for the voltage controlled production, flux, and use of one or more forms of ionizing electromagnetic and/or particulate radiation including: embodiments to collect and convert the particulate radiation that is generated by the radiation generator into electricity; embodiments that generate electricity from the ionized gas within the radiation generator by means of an auxiliary electrode structure composed of interdigitated individual electrodes of alternating work function; and a method or procedure for the fabrication and the activation of at least one working electrode composed in part of a metal hydride host material that is not formally considered to be radioactive.

28 Claims, 14 Drawing Sheets

(56) References Cited

U.S. PATENT DOCUMENTS

| | | | | |
|---|---|---|---|---|
| 8,829,325 | B2 * | 9/2014 | Zuppero | H01L 29/66<br>136/205 |
| 2008/0164459 | A1 * | 7/2008 | Zuppero | H01L 29/66<br>257/29 |
| 2010/0132754 | A1 * | 6/2010 | Zuppero | H01L 29/66<br>136/205 |
| 2012/0160289 | A1 * | 6/2012 | Zuppero | H01L 29/66<br>136/205 |
| 2016/0035955 | A1 * | 2/2016 | Zuppero | H01L 35/30<br>136/205 |
| 2016/0211435 | A9 * | 7/2016 | Zuppero | H01L 35/30 |
| 2016/0244889 | A1 * | 8/2016 | Gordon | C25B 15/02 |
| 2019/0058102 | A1 * | 2/2019 | Gidwani | H01L 29/24 |
| 2020/0068690 | A1 * | 2/2020 | Gordon | H01J 61/526 |

* cited by examiner

GASEOUS-PHASE IONIZING RADIATION GENERATOR

CROSS-REFERENCE TO RELATED APPLICATIONS

This application claims the benefit of U.S. Provisional Patent Application No. 62/721,472, filed Aug. 22, 2018, entitled "GAS-PHASE IONIZATION RADIATION GENERATOR," the content of which is fully incorporated by reference herein.

BACKGROUND OF THE INVENTION

1. Field of the Invention

The embodiments and aspects described herein relate to the generation of ionizing radiation in an electrically controllable manner at temperatures, pressures, and electric field strengths.

2. Background Art

Current art teaches several methods for the production or generation and use of ionizing radiation ionizing radiation is produced spontaneously by the decay of radioactive materials. In addition, ionizing radiation is produced by nuclear fission and by nuclear fusion. However, electrically controlled generation of ionizing radiation is most commonly achieved by either the acceleration of charged particles or ions, e.g., synchrotron radiation, or by the deceleration of charged particles, e.g., x-ray radiation. Recently, the ability to produce ionizing radiation was described in U.S. Pat. No. 8,419,919 titled "SYSTEM AND METHOD FOR GENERATING PARTICLES," U.S. Pat. No. 8,419,919 teaches that properly prepared electrochemical cells utilizing a liquid electrolyte will produce multiple forms of ionizing radiation during electrolysis.

As distinguished from current art, one novel feature of the gaseous-phase ionizing radiation generator described herein is that electrically-controlled ionizing radiation may be produced utilizing a gas or vapor which greatly extends breadth of applications for the ionizing radiation that is produced. Another novel feature of the gaseous-phase ionizing radiation generator is that naturally radioactive materials may not be required.

SUMMARY OF THE INVENTION

The inventive features of this novel gaseous-phase ionizing radiation generator device, also known herein as a cell or radiation generator cell, include: a device for the voltage controlled production and flux of one or more forms of ionizing electromagnetic and/or particulate radiation; a device to produce ionizing radiation that does not require the use of, materials that are normally considered to be naturally radioactive; a means or device to collect and convert into electricity the particulate radiation that is generated by the radiation generator cell; a device that generates electricity from the ionized gas within the cell by means of an auxiliary electrode structure composed of electrodes of alternating work function; and a method or procedure for the fabrication and the activation of at least one working electrode composed in part of palladium host material electrodeposited from a light water aqueous solution of $PdCl_2$ and LiCl salts at a temperature essentially at or below the Debye temperature of palladium. In some embodiments, performance may be enhanced by heating the working electrode, operation at a gas or vapor pressure above or below atmospheric, operation at a gas or vapor temperature greater than 100° C., and the inclusion of a magnetic field that permeates the hydrogen host material of the working electrode to alter the dynamic motion of the atoms therein, or a combination of these enhancements.

This enhanced performance may be achieved through the use of novel fabrication and working electrode processing techniques and the use of materials that may not normally be considered to be radioactive. Additionally, the voltages, pressures, and temperatures used by the gaseous-phase ionization radiation generator may be substantially different from those used by conventional practice or indicated by conventional theory.

Critical components of this invention include a gas or vapor composed of at least hydrogen or deuterium, at least one or more specially prepared working electrodes, typically the cathodes, and at least one or more counter electrodes, typically the anodes, and a vessel or chamber to confine the gas or vapor wherein at least one of the electrodes must be within the vessel and the other electrode may be within the vessel or be part of the vessel, and the electrodes must be in fluidic contact with the gas or vapor. An additional critical component is a source of electrical current or potential in communication with the electrodes to generate an electric field between the working and counter electrodes in order to drift hydrogen ions toward the working electrode where fugacity may enhance the occlusion of hydrogen ions into the lattice material of the working electrode's hydrogen host material. For some embodiments, additional features may be included such as ports, valves, sealable access openings, electrical feedthroughs, additional electrodes, electrode structures, a heater, a source of magnetic field, and current limiting impedances.

A particular feature of the gaseous-phase ionizing radiation generator device is the use of a specially prepared and activated working electrode comprised in part of a hydrogen host material that will adsorb, absorb, diffuse and occlude hydrogen within its lattice. Examples of such materials include but are not limited to palladium (Pd), nickel (Ni), and alloys including other elements such as but not limited to boron (B), silver (Ag), and titanium (Ti). For some embodiments, palladium may be deposited onto another metal such as copper or copper that has been plated with silver, gold, or nickel to form the working electrode. For other embodiments, the working electrode may be comprised of a foil, sheet, rod, or screen of material that may be further deposited such as but not limited to palladium, nickel or alloys with other materials.

Preparation of the working electrode may include the deposition of palladium (Pd) or nickel (Ni) from an aqueous solution at temperatures at or below the Debye temperature of palladium (Pd) or nickel (Ni) respectively which may enhance the performance and ease of activation of the working electrode and, in addition, the inclusion of some aqueous vapor along with the hydrogen gas also may help in the activation of the working electrode.

DESCRIPTION OF THE PREFERRED EMBODIMENT

Definitions

Figure 1:
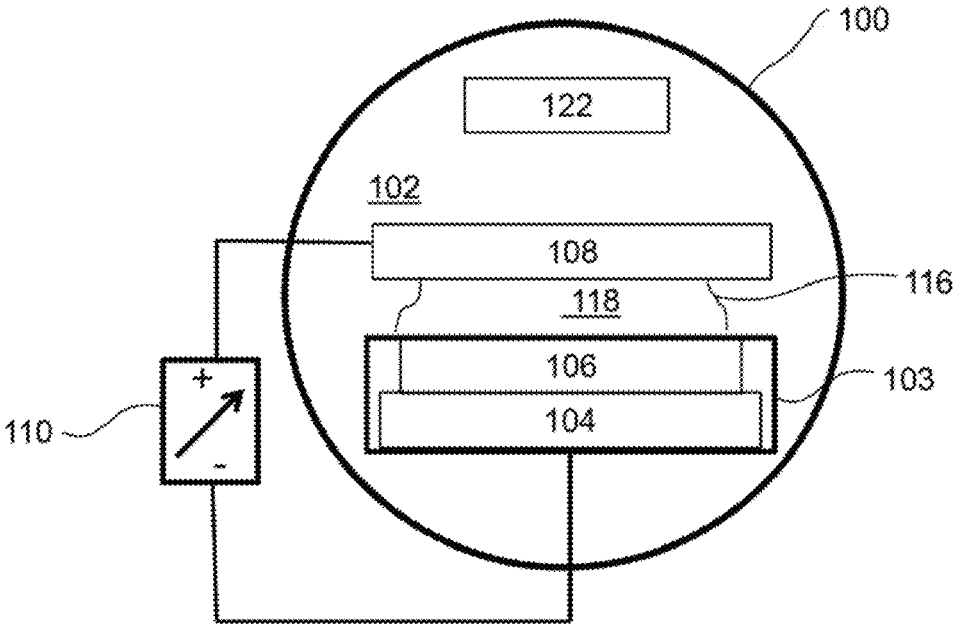
FIG. 1 illustrates the basic requirements for a gaseous-phase ionizing radiation generator.

For purposes of this document, in addition to standard scientific definitions, the following definitions also apply.

Active hydrogen host material: Active or activated hydrogen host material is host material that produces and/or emits a flux of ionizing radiation.

Aqueous: The term aqueous used herein includes light water ($H_2O$), heavy water ($D_2O$) or combinations thereof.

Cathodic hydrogen charging: "Cathodic hydrogen charging is another method, which is based on an electrochemical cell, in which the sample acts as the cathode and usually a piece of platinum act as the anode, . . . When an electrical potential is applied across the electrodes, . . . , and hydrogen ions (Protons) are produced. The applied potential causes a flux in charge carriers, both in the electrolytic solution and in the electrodes. This flux generates a high concentration of hydrogen ions on the surface of the sample. At the same time, the applied potential acts as a complementary driving force [fugacity] for diffusion of the hydrogen ions." Niklas Ehrlin et al. AIMS Materials Science, 3(4): 1350-1364, 2016. For purposes of this document, the term electrochemical cell includes the use of a gaseous or vapor electrolyte.

Cell: Throughout this document, unless otherwise defined, a 'cell' interchangeably refers to the Gaseous-phase ionizing radiation generator device and/or its physical implementations.

Contact potential: Contact potential is the difference in work functions of two materials divided by the charge of an electron.

Counter electrode: The counter-electrode forms a pair with the working electrode to produce an electric field between the electrodes when a power source is applied. The counter electrode may be a solid material such as a sheet or rod or it may be a screen or grid of wires positioned to produce the desired electric field with the working electrode.

Electric field: When a power source is supplied to the electrodes, an electric field is produced between the electrodes. The strength of the electric field is a function of the cell geometry and the current or voltage supplied.

Electrode structure: An electrode or combination of electrodes that are electrically interconnected and may include having perforations, apertures, or open areas such as but not limited to a mesh, screen, comb, grid, or perforated plates for the passage of both a gas and radiation while providing an electric field that is approximately that of a uniform electrode when paired with another electrode.

Fenestrated: Having apertures, openings, perforations, spaces, and other open areas.

Fugacity: "The fugacity f is defined as a factious pressure of ideal gas related to the excess voltage [over potential] . . . the fugacity agrees with the actual pressure of molecular hydrogen only at low pressures, $p_H$<0.1 GPa ($10^3$ atm)." Fukai, J Alloys and Compounds 404-406 (2005) pp 7-15.

Gas: A gas is defined as a state of matter consisting of particles that have neither a defined volume nor defined shape.

Hydrogen: For purposes of this application, references to hydrogen include hydrogen isotopes deuterium and tritium and their respective ions.

Hydrogen diffusion barrier: A hydrogen diffusion barrier is a material that has a low permeability to hydrogen such as but not limited to copper and stainless steel and also may include a thin layer of gold or silver plating.

Hydrogen host materials: For this application, hydrogen host materials include metallic hydride host materials such as materials that occlude hydrogen interstitially within the host material's lattice structure to form a metal hydride wherein the hydrogen forms an alloy of the hydrogen host material with atomic hydrogen. For example but not limited to nickel and palladium as well as their alloys.

Hydrogen overpotential: "Potential greater than an equilibrium potential is required to apply to the electrode to drive a hydrogen evolution [or hydrogen dissociation] reaction on the electrode surface in an electrolytic cell. Such an extra potential deviated from the equilibrium potential is called hydrogen overpotential." Masahiko Morinaga, in A Quantum Approach to Alloy Design, 2019.

Ionizing radiation: "Ionizing radiation . . . is radiation that carries sufficient energy to detach electrons from atoms or molecules, thereby ionizing them. Ionizing radiation is made up of energetic subatomic panicles, ions, or atoms moving at high speeds (usually greater than 1% of the speed of light), and electromagnetic waves on the high-energy end of the electromagnetic spectrum. Typical ionizing subatomic particles include alpha particles, beta particles, protons, and neutrons." https://en.wikipedia.org/wiki/Ionizing_radiation.

Metal hydride: " . . . hydrogen diffuse into the metal and forms a solid solution or a metal hydride . . . it should be realized that it is the hydrogen atoms which will enter the metal lattice and not the hydrogen molecule. Therefore, the hydrogen molecule should be dissociated at the metal surface or it can be adsorbed at the surface and then dissolved at interstitial sites of the host metal and forms a solid solution." J Hour (2002), "Hydrogen in Metals," In: Julien C., Pereira-Ramos J. P., Momchilov A. (eds) New Trends in Intercalation Compounds for Energy Storage. NATO Science Series (Series II: Mathematics, Physics and Chemistry), vol 61. Springer, Dordrecht, pp 109-143. https://link.springer.com/chapter/10.1007/978-94-010-0389-6_9.

Over potential: Over potential is the electrode potential [minus] equilibrium potential.

Power source: An electrical source of variable current or voltage/potential.

Vapor: A vapor includes a fluid that may be a gas and/or a mixture of two phases such as a gas and a liquid, for example but not limited to water vapor that may contain water molecules, water clusters, and equilibrium ions." H. R. Carton in "Electrical Conductivity and Infrared Radiometry of Steam", 1980.

Work Function: "The electron work function ψ is a measure of the minimum energy to extract an electron from the surface of a solid" e.g., ψ: Pd polycr(yastal) 5.22 eV, Zn polycr 3.63 eV https://public.wsu.edu/~pchemlab/documents. Work-functionvalues.pdf.

Working Electrode: The working electrode is the electrode where reactions of interest are occurring. The working electrode may be composites of materials where the reactants (hydrogen) are stored, modified, or consumed. The working electrode herein is comprised of hydrogen host materials and may include a low hydrogen permeable diffusion barrier. The working electrode becomes 'active' when it is producing one or more forms of electromagnetic and/or particulate radiation.

The inventive features described herein include a novel gaseous-phase ionizing radiation generator device, also known herein as a radiation generator or cell, for the controlled production of one or more forms of ionizing electromagnetic and/or particulate radiation. This radiation may be produced by and emitted from materials that may not normally be considered to be radioactive. Additionally, the voltages, pressures, and temperatures required for the gaseous-phase ionization radiation generator may be substantially different from those of conventional practice and theory.

Critical components of this invention include a gas or vapor or combination thereof composed at least of hydrogen or deuterium or combination thereof, at least one or more specially prepared working electrodes comprised in part of a hydrogen host material, typically the cathodes, at least one or more counter electrodes, typically the anodes, wherein the electrodes are physically separated, and a vessel or chamber to confine the gas or vapor wherein at least one of the electrodes must be within the vessel and the other electrode may be within the vessel or may be part of the vessel. Additionally, the electrodes must be in fluidic contact with the gas or vapor. Also, a source of electrical power in communication with the electrodes to generate an electric field between the working and counter electrodes may be required. For some embodiments, additional features may be included such as ports, valves, electrical feedthroughs, additional electrodes, or electrode structures, a heater, a source of magnetic field, and energy conversion devices.

Preparation and activation of the specially prepared working electrode is important. Multiple protocols have been successfully used for some applications wherein a liquid electrolyte is used (U.S. Pat. No. 8,419,919 entitled "System and Method For Generating Particles") and those protocols can be used to prepare the working electrode for the gaseous-phase ionizing radiation generator with the additional steps of removing the electrode from the liquid electrolyte and placing it in an electric field in the presence of a gas or vapor that is predominantly hydrogen or deuterium gas in order to activate the hydrogen host material. Additional protocols have been successfully used and some examples of these protocols are described for different embodiments in the detailed description of the invention. To become active, the working electrode hydrogen host material may need to have a high hydrogen loading, typically more hydrogen than will diffuse into and occlude within the hydrogen host material's lattice at standard temperature and pressure. In addition to gas pressure, it is possible to use electric fields to produce fugacity, sometimes referred to as cathodic hydrogen charging, to help adsorb, dissociate, absorb, occlude and retain hydrogen and isotopes in the hydrogen host materials. Experiments have also shown that when the conditions are right, including electric field strength, gas pressure, and a sufficiently high ratio of hydrogen and/or deuterium ions to metal atoms, the working electrode becomes 'active' and produces and emits ionizing radiation resulting in an increased conduction between the electrodes that is several orders of magnitude larger than current theory and art predicts in the absence of ionizing radiation for similar conditions of temperature, pressure, and electric field strength.

In order to sustain its active state, it may be necessary to maintain the ratio of hydrogen to metal in the working electrode's hydrogen host material. This may be accomplished by maintaining the electric field and/or the hydrogen gas pressure. Hydrogen and its isotopes and ions will diffuse through metals such as palladium so it may be important to construct the working electrode in such a manner to include a non or low-hydrogen permeable barrier to prevent hydrogen from diffusing out of the palladium or other hydrogen host material. The low hydrogen permeable barrier prevents hydrogen from diffusing out of the hydrogen host material and in combination with fugacity, high loading ratios of hydrogen to metal atoms in the lattice material can be maintained. For some applications where the use of a non or low-hydrogen permeable barrier is not used, cathodic hydrogen charging or fugacity may be used to surround the working electrode to contain the hydrogen. The counter electrodes are typically an electrical conductor that does not need to absorb hydrogen.

Multiple materials, gas-phase ionizing radiation generator designs, physical configurations, and preparation techniques when using a prepared working electrode that has been activated, have experimentally been shown to successfully produce radiation to ionize the gas and conduct significantly more current than conventional theories and teaching predict, or when using unprepared or blank cathode for comparison.

For the purposes of promoting an understanding of the concepts of the invention, reference will now be made to a few embodiments illustrated in the drawings and specific language will be used to describe the same. It will nevertheless be understood that no limitation of the scope of the invention is thereby intended. Any alterations and further modifications in the described embodiments, and any further applications of the concepts of the invention as described herein are contemplated as would normally occur to one skilled in the art to which the invention relates.

FIG. 1 provides a basic functional description of the gaseous-phase ionizing radiation generator. Components included are a gas or vapor including hydrogen or deuterium 102, a vessel 100 to confine the gas or vapor or combination thereof, at least one working electrode 103 which may be composed in part of a low hydrogen permeable material 104 and a hydrogen host material 106, and at least one counter electrode 108 wherein the working and counter electrodes are physically separated from each other. Also shown is a power source 110 connected between the electrodes to provide the power to produce an electric field to cause hydrogen to diffuse into the hydrogen host material and activate the hydrogen host material as well as the power to maintain and operate the cell after hydrogen host material activation. The electric field alters the random motion of the gas or vapor ions present in the cell to acquire an additional component motion or flux of ions that transmits or drifts positive ions toward the cathode and negative ions toward the anode with ion velocities that are a function of the electric field strength. Additionally, the electric field may provide fugacity or cathodic hydrogen charging which generates a high concentration of hydrogen ions on the surface of the hydrogen host material. At the same time, the applied potential and resulting electric field acts as a complementary driving force or equivalent pressure for diffusion of the hydrogen ions into the hydrogen host material. After a period of time of cathodic hydrogen charging the hydrogen host material may become active and produce ionizing radiation 116 that is emitted from the hydrogen host material which thereby ionizes the gas or vapor or combination thereof to produce a weakly ionized plasma 118. In some ways, this embodiment is similar to a light bulb or fluorescent tube which contains electrodes and a gas and may also contain a phosphor or other enhancements that are sealed in a vessel so that when the light bulb is produced, no additional ports or valves are required. Additional electrodes and structures (e.g., 122) such as ports and valves for the passage and pressure of the gas or vapor into and out of the vessel and combinations of additional electrodes and structures may provide a variety of additional functions or capabilities.

Many applications of ionizing radiation are known including the use of electrodes or electrode structures, which may be called, targets or collectors, to intercept and collect ionized particulate radiation and convert it into a voltage or a current; semiconductor devices including photovoltaics, alphavoltaics, and betavoltaics to intercept and convert particulate and electromagnetic radiation into a voltage and current, devices or device structures such as contact potential batteries, consisting of interdigitated electrodes of different work function that combination with the positive and negative ions in the gas extract energy from the gas and convert it into a voltage. While these and many other possibilities are well known, their implementation has been limited in part because they all require a source of ionizing radiation that is typically from the decay of radioactive materials. The gaseous-phase ionizing radiation generator has the possibility to provide and control the flux of ionizing radiation without requiring the use of materials that are naturally radioactive.

Figure 2:
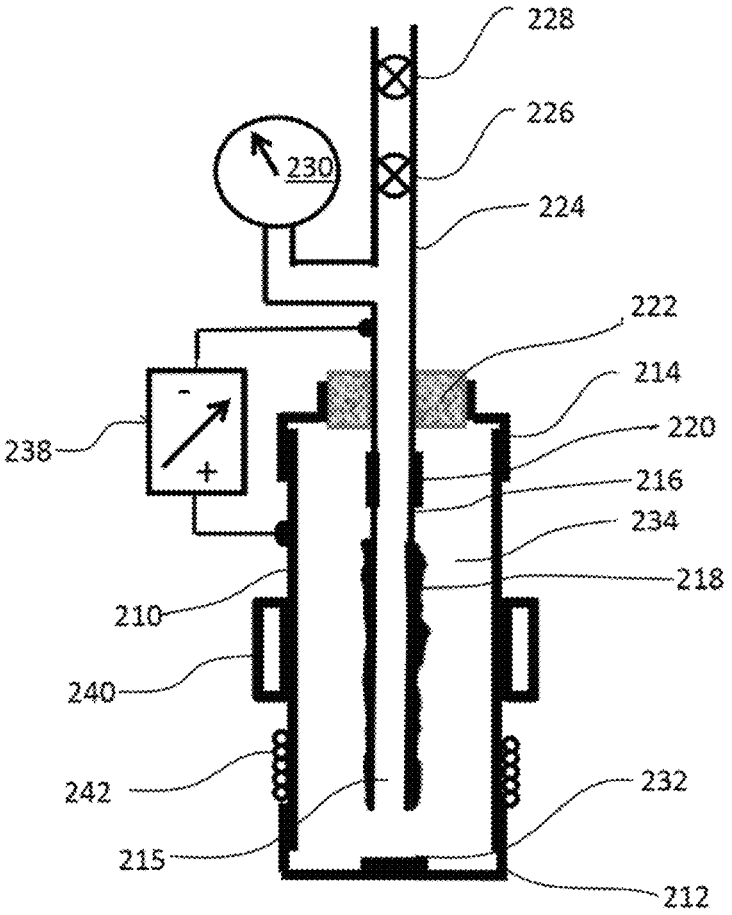
FIG. 2 illustrates one embodiment of a coaxial cylinder design for a gaseous-phase ionizing radiation generator.

FIG. 2 illustrates one embodiment 200. For this embodiment, preparation of the working electrode 215 may be composed in pan of a low hydrogen permeable barrier material electrode 216 and a hydrogen host material 218. The electrode 216 which may be comprised of a ¼" diameter copper tube approximately 4 inches long may be cleaned with a sodium chloride (NaCl) and acetic acid aqueous solution. After cleaning and drying, a plastic cap may be placed on the electrode to prevent the plating bath from getting inside the electrode and then the copper tube is placed in a silver plating bath. The silver plating solution may be a commercially available product, for example the Krohn "Ready-To-Use Silver Electroplating Solution". For silver plating, the Cu tube is the cathode and a silver wire is the anode. Approximately 3.3 volts is applied for one minute resulting in variable amperage over the plating time. The silver plated tube is then allowed to dry. The silver plated tube 216 provides a low hydrogen permeable material as a diffusion barrier for hydrogen.

For this embodiment, palladium may be the hydrogen host material although other materials and alloys are anticipated. A palladium overcoat 218 may be then electrodeposited in the following manner: The silver plated copper tube 216 is the cathode in an electroplating bath typically comprising light water ($H_2O$) aqueous 0.15 molar LiCl solution and enough light water aqueous plating solution of 0.03 molar $PdCl_2$ and 0.3 molar LiCl added to form a co-deposited metallic palladium hydride layer about 1500 atoms thick on the surface to be plated. The plating bath and cathode typically are cooled to less than 4° C. which is a reported Debye temperature for Pd although higher temperature plating baths have been used successfully. The anode for the co-deposition palladium plating typically is platinum wire. The plating is started using a typical current density of approximately 0.008 amperes per square centimeter of surface area. The surface area is typically about 12 square centimeters and typically about 6 volts and 0.10 amps are applied for 15 minutes. After approximately 15 minutes the current is increased to approximately 0.08 amperes per square centimeter, typically requiring about 22 volts and 1.0 ampere for approximately 45 minutes. At this point, an additional amount of light water aqueous 0.03 molar $PdCl_2$ and 0.3 molar LiCl plating solution is added to form another palladium layer about 1500 atoms thick on the surface being plated. After a further hour at approximately 0.08 ampere per square centimeter current in the electroplating bath, the plated electrode is removed from the electroplating bath and allowed to dry for approximately 18 hours. After the approximately 18 hour period, the plating procedure from above may be repeated to put additional coats of co-deposited palladium on the electrode. Multiple platings may be performed onto the silver plated electrode 216 to provide a desired thickness of co-deposited palladium hydrogen host material 218 to form the working electrode 215. Alternative plating protocols have produced successful working electrodes such as those described in U.S. Pat. No. 8,419,949 and in Szpak et, al. J. Electroanal. Chem, 302 (1991) 255-260 which use normal room temperature $D_2O$ plating, baths. Additionally, different voltages, current densities, and time profiles as well as substituting $H_2O$ for the $D_2O$ aqueous plating solution have been successful.

For this embodiment 200, a ¾" by 4.5" brass nipple 210, an end cap 212 which provides a sealable access to the interior of the vessel, a bushing 214, and an electrically insulating bushing 222 form the gas-phase ionizing radiation generator vessel and which also may serve as the anode or counter electrode. The manifold 224 may be assembled using standard pipe fittings to assemble brass valves 226 and 228, a compound pressure gauge 230. The manifold 224 passes through a nylon or PTFE insulating bushing 222 and may be connected to the working electrode 215 by means of a coupling 220 so that electrical connectivity is maintained between the working electrode and the manifold which also serves as the cathode as well as a port for gas or liquid passage into and out of the vessel.

A calculated amount of Li foil, 232, typically about 0.126 grams for the experimental cell described above, is placed in the bottom of the end cap 212 and the cell is assembled by screwing end cap 212 onto the brass nipple 210. Care is taken to be sure that all fittings are gas tight.

The assembled cell is connected to a variable power source 238 capable of supplying up to 1000 volts and 6 mA which may be implemented either as a current source or a voltage source wherein the positive terminal of the power source is electrically connected to the nipple 210 and the negative terminal of the power source is electrically connected to the manifold 224 which in turn is in electrical contact to the working electrode assembly 215 by means of the coupling 220. The cell may be connected to a computerized, 14 channel LabJack instrumentation recording system, not shown, typically set to record 512 samples per second to measure the cell's performance including the current through and voltage across the cell. A vacuum pump is attached, for example to the open end of valve 228 and valves 228 and 226 are opened. A vacuum is pulled until the compound pressure gauge 230 measures approximately −28" Hg. Valve 226 is now closed and the vacuum lines removed from valve 228. A predetermined amount of $D_2O$, typically 1 ml, can be inserted between valve 226 and 228. Valve 228 is then closed and valve 226 is opened, allowing the $D_2O$ to drop down through the cathode 215 onto the Li foil 232 wherein it reacts to form $D_2$ gas and Li deuteroxide. It is important to allow sufficient separation between the bottom of the cathode 215 and the Li 232 so that a short will not occur between the anode and the cathode as the Li 232 reacts when $D_2O$ is added to the assembled cell. The Li foil should have sufficient number of moles so that when it is reacted with an excess amount of $D_2O$ the resultant $D_2$ gas 234 will have the desired pressure, typically 15 to 30 psig for the volume of the cell 200. The variable power source 238 is turned on to provide a current source which is typically set to supply between 500 to 1000 μA. If the working electrode is not active, the voltage across the cell typically goes to the compliance limit set by the variable power source which is usually set between 500 and 1000 volts. Care must be taken for both personnel safety and to protect the instrumentation to accommodate the high voltage and current. For the above geometry, the voltages are typically approximately 750 volts for activation of the hydrogen host material although a range of voltages has been used successfully. Activation of the working electrode involves loading deuterium into the working electrode to form a metal deuteride. Two different mechanisms contribute to this process. One is by the gas pressure in die vessel and the other is by fugacity, also called cathodic hydrogen charging where the $D_2$ gas is adsorbed and deuterium is absorbed by diffusion and stored or occluded in the working electrode's hydrogen host lattice material. Although the initial conduction in the cell may be low because it results primarily from the small conductivity of the $D_2O$ vapor in the deuterium gas, fugacity is occurring to assist the loading of deuterium into the working electrode's hydrogen host lattice material. As more deuterium is adsorbed, absorbed and diffused into or occluded in the working electrode's hydrogen host material in the form of a metal deuteride, the working electrode may become 'active' causing the conduction to increase by several orders of magnitude and the voltage across the cell will be reduced as more current flows through the cell. At this point, the working electrode is "activated" wherein the ionizing radiation produced ionization of the gas resulting in increased current through the cell as shown in FIG. 3 and thereby reduces the voltage across the cell as shown in FIGS. 4 and 5.

It should be noted that a potentiostat-galvanostat combines the functions of a variable power source with current sensing and current limiting however the compliance voltage of many commercial potentionstat-galvanostats typically have a compliance limit of 100 volts or less which may be insufficient to activate the hydrogen host material in the working electrode through a gas or vapor.

Performance enhancements included in FIG. 2 include the addition of a heater 242 to heat the working electrode and a means of generating a magnetic field, such as permanent or electro-magnets 240, to permeate and thereby alter the motion of the atoms in the hydrogen host material including its occluded hydrogen 218.

Figure 3:
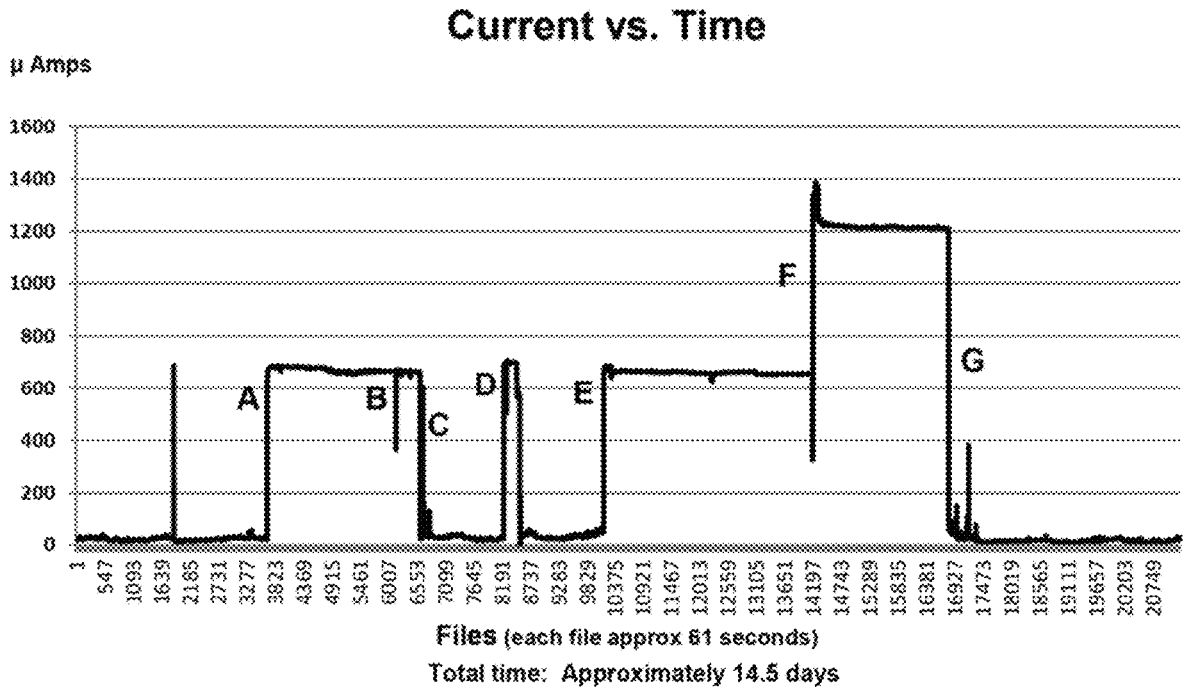
FIG. 3 shows plots of experimental results for a 2-week period showing the current being conducted vs. time for the gaseous-phase ionizing radiation generator embodiment shown in FIG. 2.

FIG. 3 is a plot of 21,279 files of approximately 61 seconds each, representing 14.5 days of data using the embodiment described in FIG. 2. This particular cell had been under test for several months during which time multiple periods of high current conduction occurred. The initial pressure in the cell was approximately 15 psig but after several months of operation, it had declined to approximately −7" Hg at the time of data shown in FIG. 3. Similar pressure changes have been observed in other operating cells. These pressure changes indicate that some form of a reaction involving the gas or vapor is taking place. The power source was set to a compliance limit of 750 volts for the duration of these tests except for 2 files located at file number 6158-9. FIG. 3 illustrates periods of time when the cell conduction is approximately 15 to 40 μA followed by periods of time when conduction increased to approximately 680 μA which are annotated "A" "D," and "E." Due to the change in current resulting in a change in the compliance limit, the actual voltage across the cell was approximately 120 volts when the conduction was 680 μA. During files 6158-6159, annotated as "B" on the plot, the compliance limit voltage was reduced in steps of 100 volts for a few seconds at each level resulting in the current through the cell being reduced in steps of approximately 90 μA. The compliance voltage was then increased in steps of 100 volts a maximum of 850 volts before being returned to 750 volts. This increase in compliance voltage resulted in an increase in current in steps of approximately 90 μA. Plots of FIG. 3 are the file average. The one-second averages of voltage and current during this test are shown its FIGS. 4A and 4B.

At file number 14,208, annotated as "F" on the plot, the power source was modified to change its impedance so that twice the current could flow through the cell for the same compliance voltage. The current sensing capability was also modified to protect the instrumentation. This resulted in a momentary drop in current through the cell while the changes were made followed by an increase in current through the cell to approximately 1200 μA. The actual voltage across the cell during the period of 1200 μA conduction was approximately 180 volts. At file number 16818, annotated, as "G" on the plot, the power source impedance was further modified to allow even more current to flow through the cell. The cell conduction increased for a few milliseconds and then dropped below 100 μA. This drop indicates that the ionization being produced was no longer able to keep up with that level of current. The experimental data shown in these figures demonstrate the ability to control the rate of ionization production by controlling the current through and voltage across the cell. This behavior has been observed in multiple test cells with one cell producing 760 μA for 30 hours while the actual voltage across the cell was 60 volts. In multiple experiments wherein a bare copper working electrode without hydrogen host material was used, the current measured typically ranged between 0 to 5 μA at voltages across the cell of 750 volts, which is approximately what conventional theories predict for conduction through a gas or vapor in the absence of ionizing radiation.

Figure 4A:
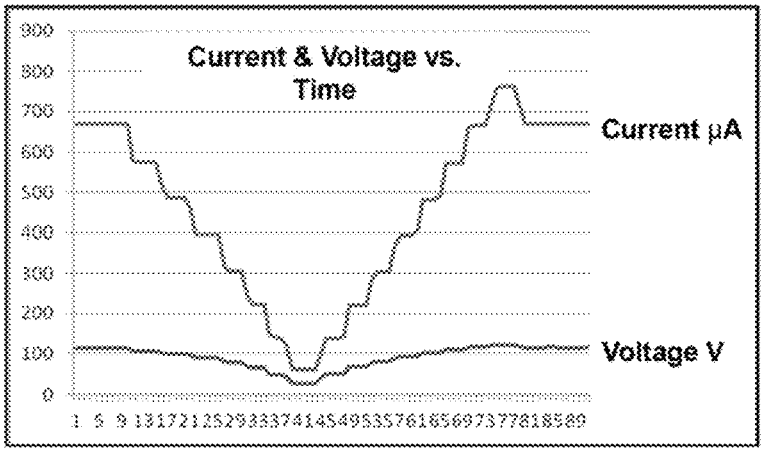
FIG. 4A shows plots of the current and voltage during a test in which cell voltage was dropped in steps.
Figure 4B:
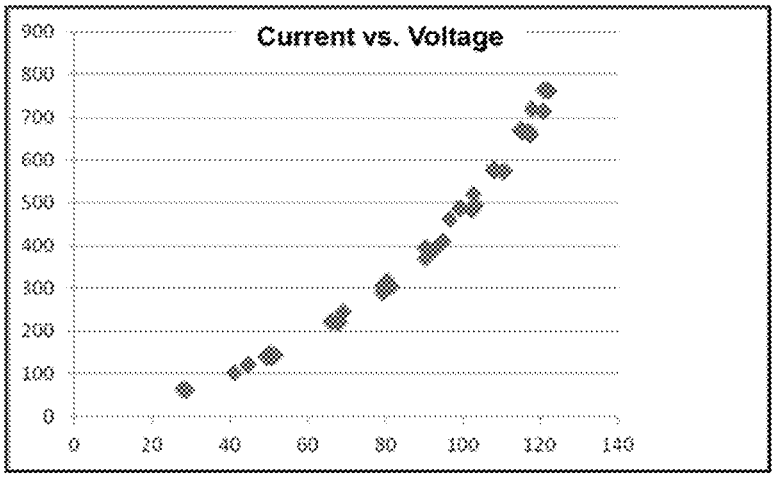
FIG. 4B shows plots of the same data as FIG. 4A plotted as Cell Current vs. Cell Voltage.

The novelty of the gaseous phase ionizing radiation generator is shown in FIG. 4, a two part figure showing two different ways of presenting the ionizing data resulting from the room temperature test described in FIG. 3. FIG. 4A is the one-second average of data recorded at 512 samples per second from files 6158-9, annotated as "B" from FIG. 3 during which time the variable current produced by the power source was reduced in steps of approximately 90 μA per step while the voltage across the cell changed from an initial voltage of 115 volts to a low of 28 volts. The current was then increased in steps of approximately 90 μA per step resulting in an increase in voltage. FIG. 4B shows the same data plotted as current vs. voltage (I-V). The data shows that it is possible to control the rate of ionizing radiation being produced as is shown below. The I-V plot also indicates a distinct exponential curve which is consistent with similar experiments performed on other cells. This indicates that the rate of ionizing radiation produced is exponential as determined by the ratio of current divided by voltage, and is greater at higher voltages across the cell as described in FIG. 3.

In 1906 the Nobel Prize in Physics was awarded to Joseph John Thomson "in recognition of the great merits of his theoretical and experimental investigations on the conduction of electricity by gases." Thomson provided an extensive account of the conduction of electricity through gases as a function of pressure, temperature, and gas composition, presented in Volume 1 of his 3rd Edition book, Conduction of Electricity Through Gases, coauthored with his son G B Thomson and published in 1928. In this volume are reported extensive studies on the behavior gases ionized by alpha-particle radiation as well as by Röntegen or X-rays. In Chapter IV of their 3rd Edition entitled Mathematical Theory of the Conduction of Electricity Through a Gas Containing Ions, he showed that in order for a gas to have significant conduction there must be ions present in the gas. Since there is no other significant source of ions present in the gaseous-phase ionizing radiation generator, the observed conduction and thus the ionizing radiation must be produced and emitted by the activated hydrogen host material of the working electrode or cathode. Additionally, the shape of the I-V curves reported by Thomson for constant radiation sources are parabolic and concave down while the shape of the I-V curve for the gaseous-phase ionizing radiation generator as shown in FIG. 4B is exponential and convex up.

According to Thomson, 3rd Ed., the steady state number of ions produced per unit volume is proportional to the reciprocal of the charge of the electron, the quotient of the current through the cell divided by the voltage across the cell, and where the proportionality constant depends upon the cell geometry and the mobility of the ions as well as other variables. Thomson further states that the rate of ionization is proportional to the square of the steady state number of ions present.

When the gaseous-phase ionizing radiation generator is producing ionizing radiation, the current between the working electrode and the anode is several orders of magnitude greater than what the bare copper electrode produced or what conventional theory predicts for die voltages, pressures, and separation distances between the anode and the cathode in the gaseous-phase ionizing radiation generator.

This conduction behavior clearly establishes the novelty as well as the controllability of the gaseous-phase ionizing radiation generator. It should be noted that when a variable production rate of ionizing radiation is desired, rather than using cell voltage to control the generation, it may be more practical to initially set the cell current and then adjust the cell voltage to achieve the desired rate of production of ionizing radiation. Thus it may be useful to monitor both the current and the voltage produced by the power source during cell operation as plotted here in FIGS. 4A and 4B.

Figure 5A:
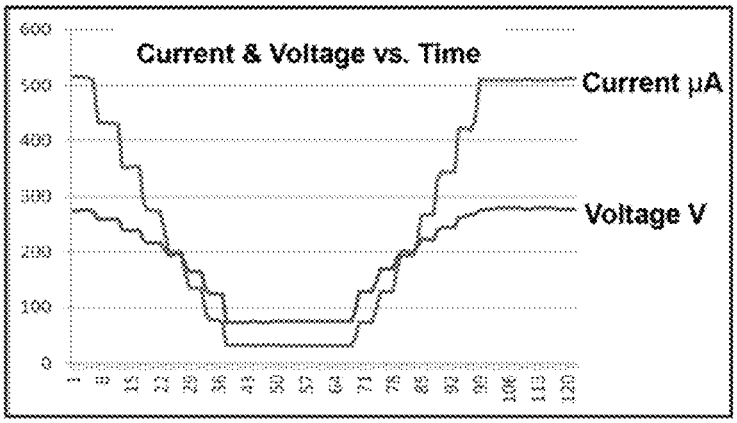
FIG. 5A shows plots of the current and voltage during a test in which the cell was cooled to −55° C. to freeze out any water vapor.
Figure 5B:
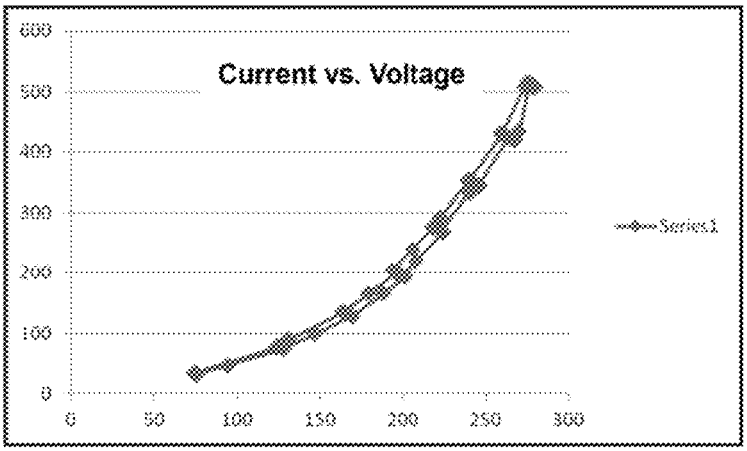
FIG. 5B shows plots of the same data as 5A plotted as Cell Current vs. Cell Voltage.

FIG. 5 is a two part figure showing two different ways of presenting the ionizing data recorded for a cold test of a different cell. Whereas the test results shown in FIG. 4 were conducted at room temperature which could include some $D_2O$ vapor ions, this test was performed at a cell temperature of approximately −55° C. in order to freeze out any $D_2O$ vapors that may be in the cell and contributing to cell conduction. FIG. 5A is the one-second average of data recorded at 512 samples per second during which time the variable current produced by the power source was reduced in steps of approximately 90 μA to per step while the voltage across the cell changed from an initial voltage of 280 volts to a low of 85 volts. The current was then increased in steps of approximately 90 μA per step resulting in an increase in voltage. FIG. 5B shows the same data plotted as current vs. voltage (I-V). As with FIG. 4B, the I-V plot also indicates a distinct exponential curve. This data wherein any water vapor had been frozen out indicates that any water vapor which may be present at room temperature does not provide significant contribution to cell conduction.

Figure 6A:
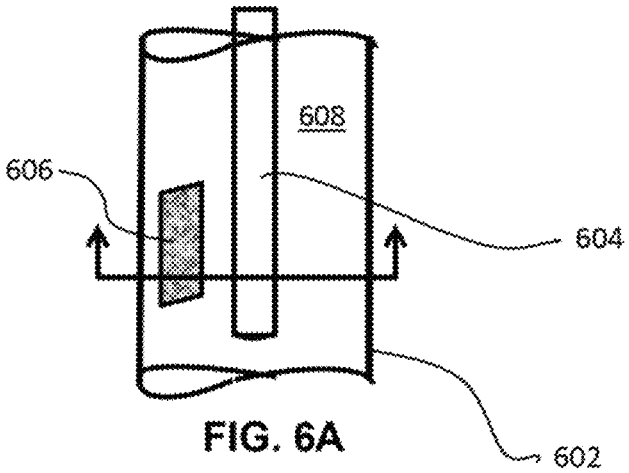
FIG. 6A provides a view of the positioning of a CR-39 Solid State Nuclear Track Detector (SSNTD) in a gaseous-phase ionizing radiation generator in preparation for a test.
Figure 6B:
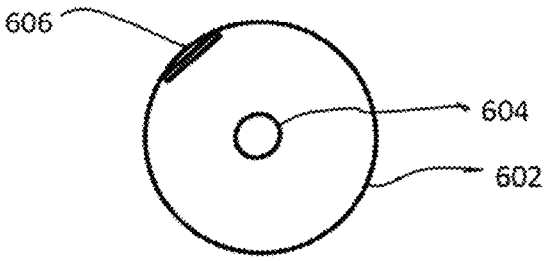
FIG. 6B is an end view showing the CR-39 placement.

FIG. 6A illustrates a cross section of a cell wherein CR-39 606 was inserted in the gaseous-phase ionizing radiation generator cell in order to detect particulate ionizing radiation. FIG. 6B is an end view to show the positioning of the CR-39. CR-39 is a highly sensitive charged particle solid state nuclear track detector (SSNTDs) that is used throughout the nuclear industry. The tracks of nuclear particles are etched faster than the bulk material and the size and shape of these tracks yield information about the mass, charge, energy and direction of motion of the particles. The main advantages over other radiation detectors are the detailed information available on individual particles, the persistence of the tracks allowing measurements to be made over long periods of time, and the simple, cheap and robust construction of the detector. In this application, the CR-39 provided detection instrumentation that was independent of the electronic instrumentation used to detect and measure conduction. As illustrated in FIGS. 6A and 6B, CR-39 606 was inserted in the gaseous-phase ionizing radiation generator cell and held in place against the interior wall of the ¾' pipe nipple 602 opposite the active working electrode 604 which included palladium hydrogen host material in the presence of deuterium gas and an electric field. After exposure, the cell was disassembled and the CR-39 removed and etched in 6.5M NaOH for 6 hours at 68° C. After etching, the CR-39 was rinsed, dried, and examined with a Fein Optic RB30 biological trinocular microscope equipped with a 40× Plan Semi-Apochromat Fluor(ite) objective lens having a numerical aperture (NA) of 0.75 so that when used in combination with a 10× eyepiece or ocular lens the microscope has a total magnification of 400×. The resulting images were photographed with a ToupTek DCxM6.3 camera which uses a Sony Exmor 1×1.8" (2916×2178) 6.35 MP 2.5 μm pixel size sensor at Microscope World in Carlsbad, Calif.

Figure 7A:
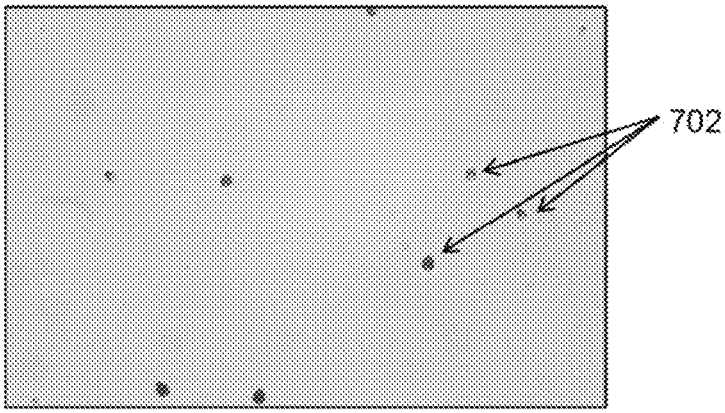
FIG. 7A is a photograph of the pits made in CR-39 by approximately 1 second exposure to Am-241 of known energy level for calibration.
Figure 7B:
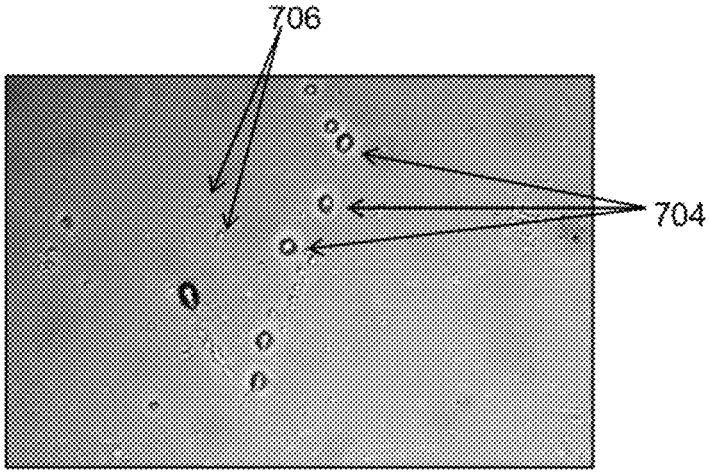
FIG. 7B is a photograph of pits in CR-39 after exposure to ionizing radiation produced in the cell.

FIGS. 7A and 7B show the etched pits that were produced after exposure to ionizing radiation after etching in NaOH. Prior to installation of the CR-39 in the cell, an area on the back side of the CR-39 chip was exposed to 1 μCi of Am-241 radiation, i.e., mostly 5.4 MeV alpha-particles and some 59.5 keV gamma rays, in contact with the CR-39 for approximately 1 second to provide a calibration of the CR-39's sensitivity to a known radiation source. Pits 702 resulting from exposure to Am-241 are shown in FIG. 7A. FIG. 7B shows the pits 704 that were produced by exposure to ionizing radiation emitted by the working electrode within a gaseous-phase ionizing radiation generator test cell. Comparing FIG. 7A and FIG. 7B provides further evidence that the experimental embodiment of the gaseous-phase ionizing radiation generator produces particulate ionizing radiation that includes particles, probably α, at similar energy levels as the Am-241. Additionally, the smaller tracks 706 indicate the presence of either particles of another particle type, possibly protons, or other α particles of a different energy.

These experimental results show that the ionizing radiation emitted by an activated palladium (Pd) hydrogen host material occluded with deuterium (D) may include multiple forms of ionizing radiation. While the pits in CR-39 clearly indicate the presence of particulate radiation, the large conduction currents as shown in FIGS. 3, 4, and 5 suggests that additional forms of radiation, such as electromagnetic, also may contribute to the conduction. Furthermore, it is known, Thomson 3$^{rd}$ Ed, that the ion pairs in the gas will recombine and this recombination will emit electromagnetic energy, some of which is in the visible spectrum which could be captured by a photovoltaic device. If the vessel is comprised of glass or another material that is transparent to visible light, photovoltaic devices may be positioned external to the cell to recover some of the energy caused by recombination of the ions produced by the ionizing radiation without particulate radiation possibly damaging the photovoltaic device. Another possibility is to apply a phosphor, such as that used by a fluorescent light tube, on the inside of the glass vessel to capture and reradiate other regions of the electromagnetic spectrum, such as the ultra violet.

Figure 8:
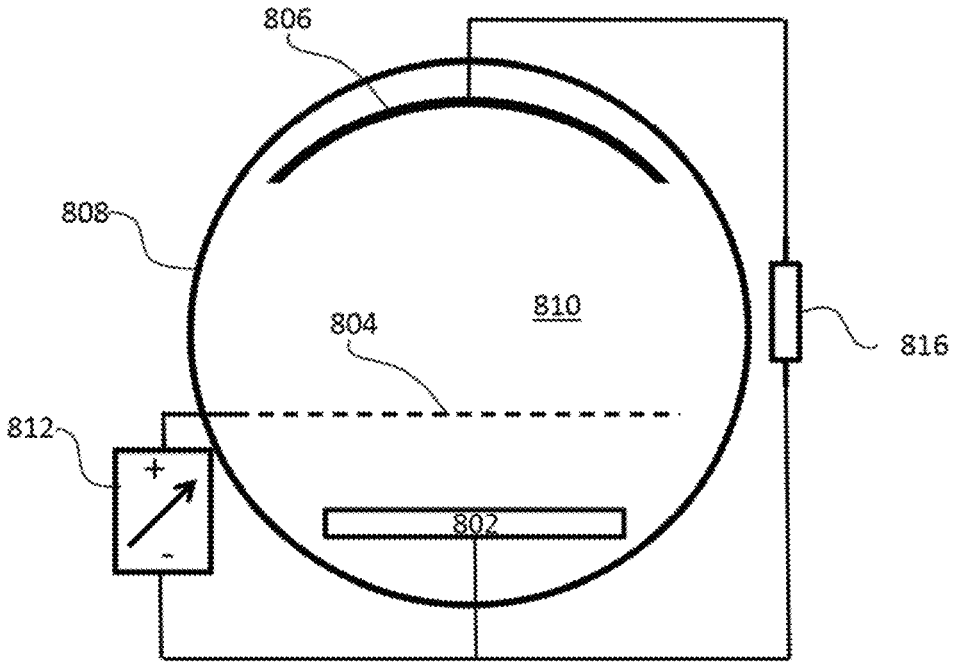
FIG. 8 illustrates a cross section view for an embodiment of a 3-electrode gaseous-phase ionizing radiation generator embodiment wherein the anode (counter electrode) is a grid with openings to allow particles to pass through to a collector.

FIG. 8 shows a cross section of the functional elements of a three-electrode cell embodiment wherein the containment vessel 808 is filled with a gas or vapor that includes hydrogen or deuterium 810, a working electrode or cathode 802 that includes palladium hydrogen host material on a low-hydrogen permeable base material, and an anode electrode structure 804 that may, consist of a copper (Cu) wire screen or another fenestrated electrode structure that will create an electric field with the working electrode while allowing ionizing radiation to pass through. A power source 812, previously described, is connected between the counter electrode and the working electrode to provide a current or voltage to produce the electric field which is used to both activate and sustain the generation of ionizing radiation being emitted from the working electrode's hydrogen host material. Ionizing radiation will pass through the openings of the fenestrated counter electrode structure 804 to further ionize the gas and impinge upon the collector 806. If the collector is composed of Beryllium and its alloys, neutrons may be generated in response to impact by energetic α particles. If the collector is connected to the working electrode through a load impedance 816, an electric voltage and current may be produced across the load impedance as shown in FIG. 9.

An alternative embodiment of the multi-electrode ionizing reactor cells of FIG. 8 is to replace or augment the collector 806 with semiconductor energy recovery devices, sometimes known as voltaics. Three types of voltaic devices have been developed, i.e., alpha-voltaics that develop electricity from α-particles, beta-voltaics that develop electricity from β-particles or energetic electrons, and photovoltaics or photocells that develop electricity from electromagnetic radiation or light at different wavelengths, e.g., gamma-rays. X-rays, ultraviolet (UV) light, and visible light.

Figure 9A:
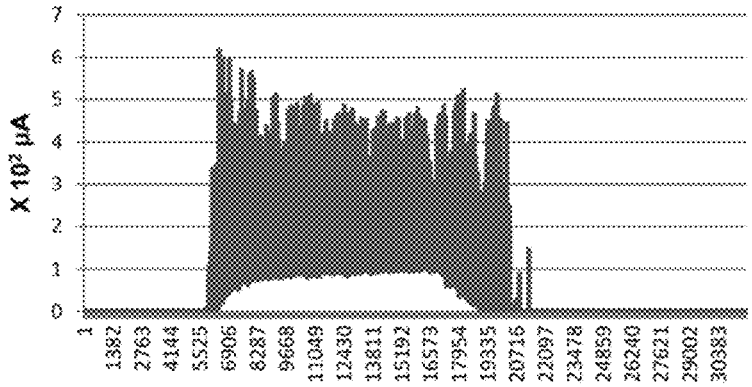
FIG. 9A plots experimental results of the current between the working electrode and the grid from a 3-electrode embodiment of FIG. 8.
Figure 9B:
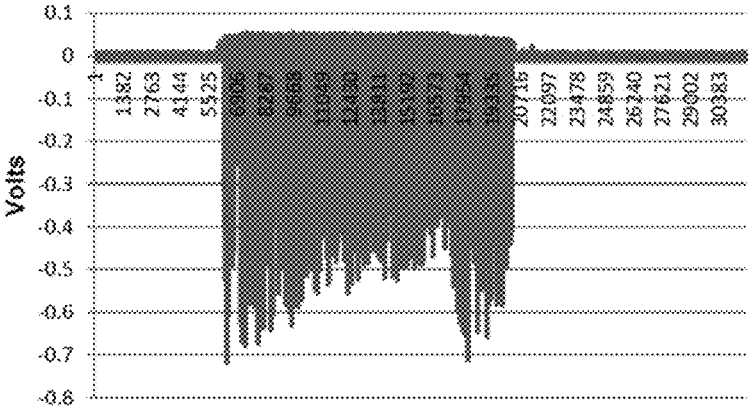
FIG. 9B plots experimental results of the voltage between the working electrode and the collector from the 3-electrode embodiment of FIG. 8.

FIGS. 9A and 9B present experimental results from a 3-electrode configuration similar to that shown in FIG. 8, in which the working electrode was a palladium hydrogen host material co-deposited onto flat copper sheet. The area of the working electrode was approximately 6 cm$^2$. The counter electrode was a copper screen that was positioned approximately 3 mm from the palladium surface and the collector was a flat copper sheet that was positioned approximately 20 mm from the palladium surface of the working electrode. FIG. 9A shows the current that was produced between the counter electrode and the working electrode. FIG. 9B shows the current that was collected between the collector and the working electrode.

Figure 10A:
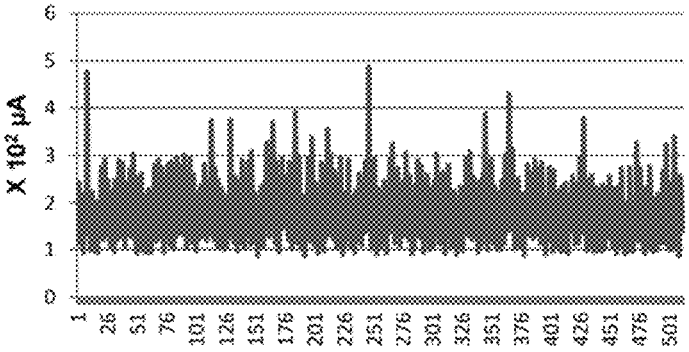
FIG. 10A is a plot of 1 second of data recorded at 512 samples per second from the plot of FIG. 9A.
Figure 10B:
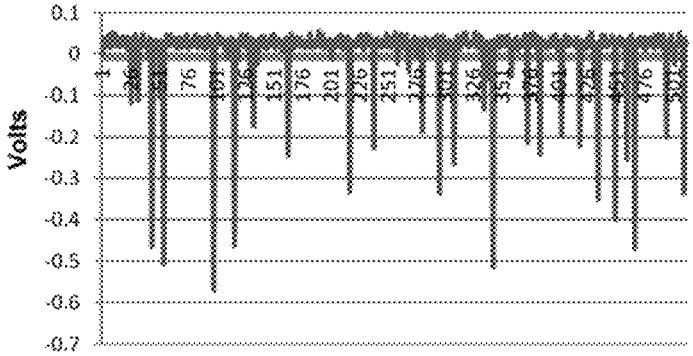
FIG. 10B is a plot of 1 second of data recorded at 512 samples per second from t e plot of FIG. 9B.

FIGS. 10A and 10B show 1 second of data from FIG. 9 sampled at 512 samples per second. FIG. 10A displays currents ranging from approximately 100 μA to as high as 500 μA due to the conduction current between the working electrode and the copper wire screen counter electrode in response to ionizing radiation being emitted. FIG. 10B shows the voltage produced at the collector resulting from the current flowing through a 10 kΩ load impedance. The current through the 10 kΩ load impedance is composed of two pans; a slight continuous positive current interspersed with downward spikes which may be interpreted as contributions from particulate radiation impinging on the collector.

Figure 11A:
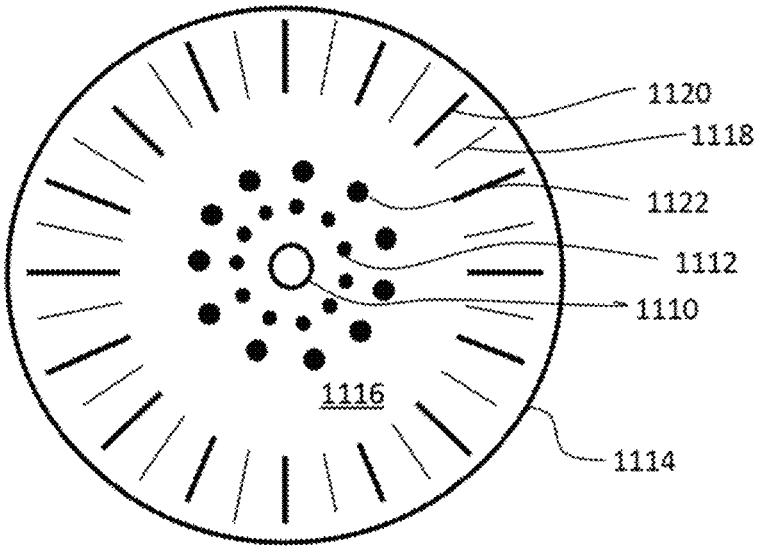
FIG. 11A illustrates an end view embodiment with multiple electrode structures to produce and use ionizing radiation to produce electricity.
Figure 11B:
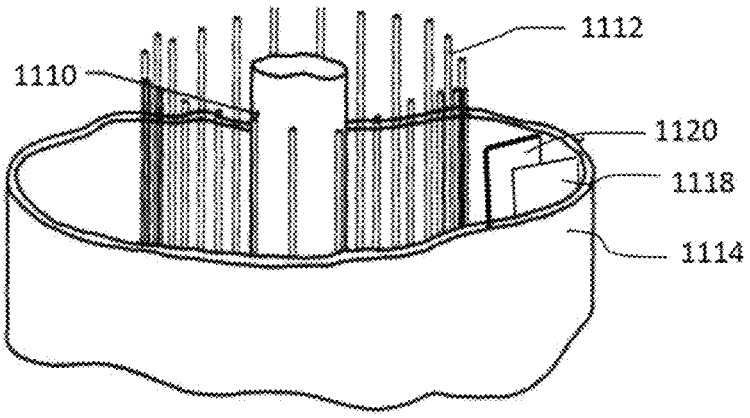
FIG. 11B illustrates a 3-dimensional section of the embodiment shown in FIG. 11A.

FIG. 11A provides an end view for a concept for using ionizing radiation to produce electricity in which the working electrode 1110 is positioned in the center of a spaced anode electrode structure 1112 whose elements are electrically connected to a source of current or potential, not shown, and electrically connected together in order to surround and produce an electric field with working electrode, the cathode, while allowing radiation to pass through the anode structure. As shown in FIG. 11B, at a radial distance away from that anode structure 1112 are groups individual electrodes made of sheet material with two different work functions 1118 and 1120 wherein the electrodes of the same work function are electrically connected together in parallel to form two electrode structures which may be interdigitated and may be positioned around the working electrode with the hydrogen host material 1110 and anode structure 1112. The ionizing radiation emitted from the hydrogen host material will ionize the gas wherein the positive ions and the negative ions will migrate toward and be collected by the electrodes of different work function. The interdigitated electrode structures 1118 and 1120 when connected to a load impedance, not shown, will produce a voltage and current. This embodiment is similar to a nuclear-powered contact potential battery that was first reported by Lord Kelvin in 1897 and further reported by Bronwell (dtic ADA281171). As others have reported, contact potential difference batteries are not practical because of the energy required to ionize the gas and the radioactive materials required. However, the gaseous-phase ionizing radiation generator has demonstrated a novel method to ionize the gas that does not require naturally radioactive materials.

The open circuit voltage generated by a contact potential battery is the difference between the high work function and the low work function of the electrodes measured in electron volts, eV divided by the charge of the electron e. For example, the work function of polycrystalline palladium (Pd) measured using the photo-electric effect is $\psi_{Pd}$5.22 eV while the work function of polycrystalline zinc Zn) measured the same way is $\psi_{Zn}$=3.63 eV. Thus the expected open circuit voltage $V_{oc}$ should be approximately $V_{oc}$=5.22–3.63=1.59 V. The entire assembly may be contained in a vessel 1114 that is filled with deuterium gas 1116. Radiation emanating from the working electrode's hydrogen host material will ionize the gas thus forming a gaseous electrolyte of positive and negative ions. Particulate radiation loses most of its energy at the end of its flight as described by the Bragg curves. Positive and negative ions produced in the gas will migrate toward the lower and higher work function electrodes. Cell performance can be optimized by adjusting the gas pressure and separation distance between the working electrode's hydrogen host material and the interdigitated electrode structures 1118 and 1120. The optional additional electrode structure 1122 is shown in FIG. 11A wherein the optional additional electrode structure run be connected to a potential source such a ground potential, to influence and control the contact potential battery's voltage relative to ground.

An alternative embodiment of the multi-electrode ionizing reactor cells of FIG. 11 is to replace or augment the energy recovery electrode structure 1118 and 1120 with semiconductor devices known as voltaics, as described in FIG. 8.

Figure 12A:
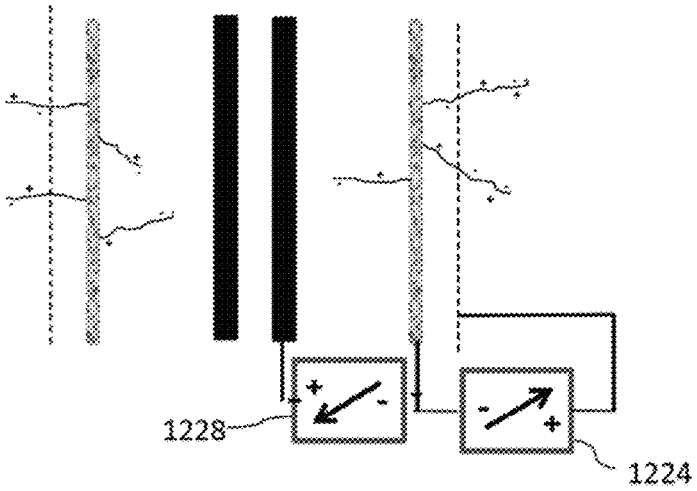
FIG. 12A illustrates a section view of an embodiment of the gaseous-phase ionizing radiation generator wherein the ionizing radiation may be used to ionize a gas that is outside the cell.
Figure 12B:
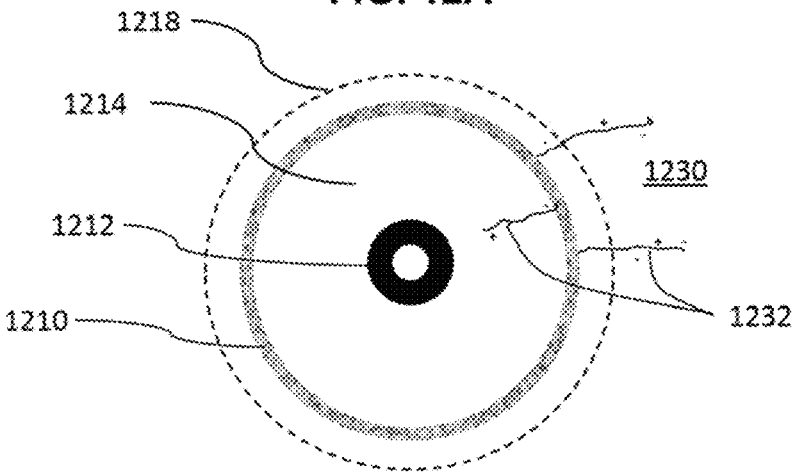
FIG. 12B illustrates an end view of the embodiment of FIG. 12A.

FIG. 12A illustrates a cut away section and FIG. 12B illustrates an end view of another possible embodiment in which the working electrode 1210 forms the wall of the vessel to confine the gas or vapor containing hydrogen and isotopes and ions of hydrogen 1214 and the counter electrode 1212 which is inside the vessel. The working electrode is comprised of hydrogen permeable material and hydrogen host material. A power source 1228 is connected between the working electrode, the cathode, and the counter electrode, 1212, the anode, positioned inside the vessel to produce an electric field to cause positive hydrogen or deuterium ions to drift to the working electrode where they am adsorbed, dissociated, absorbed, and diffuse into the lattice of the hydrogen host material. An additional fenestrated anode structure which may be comprised of a grid or spaced wires 1218 may be positioned near the outside wall of the vessel that is formed by the working electrode. A power source 1224 is connected between the working electrode 1210 and the external fenestrated anode structure 1218 to produce an electric field to retain the hydrogen or deuterium within the hydrogen host material while allowing ionizing radiation 1232 to pass through to ionize the gas on that side of the working electrode. Two variable power sources previously described are shown as 1224 and 1228 to activate and control the production of the ionizing radiation 1232.

It should be recognized that this embodiment provides a way to ionize a gas that is external to the cell and may not contain hydrogen or deuterium gas or vapor by surrounding the gaseous-phase ionizing radiation generator shown in FIG. 12 with a separate container, not shown, to contain the specific gas desired wherein the separate container may also include ports for inflow and exit of the specific gas to be ionized.

Figure 13:
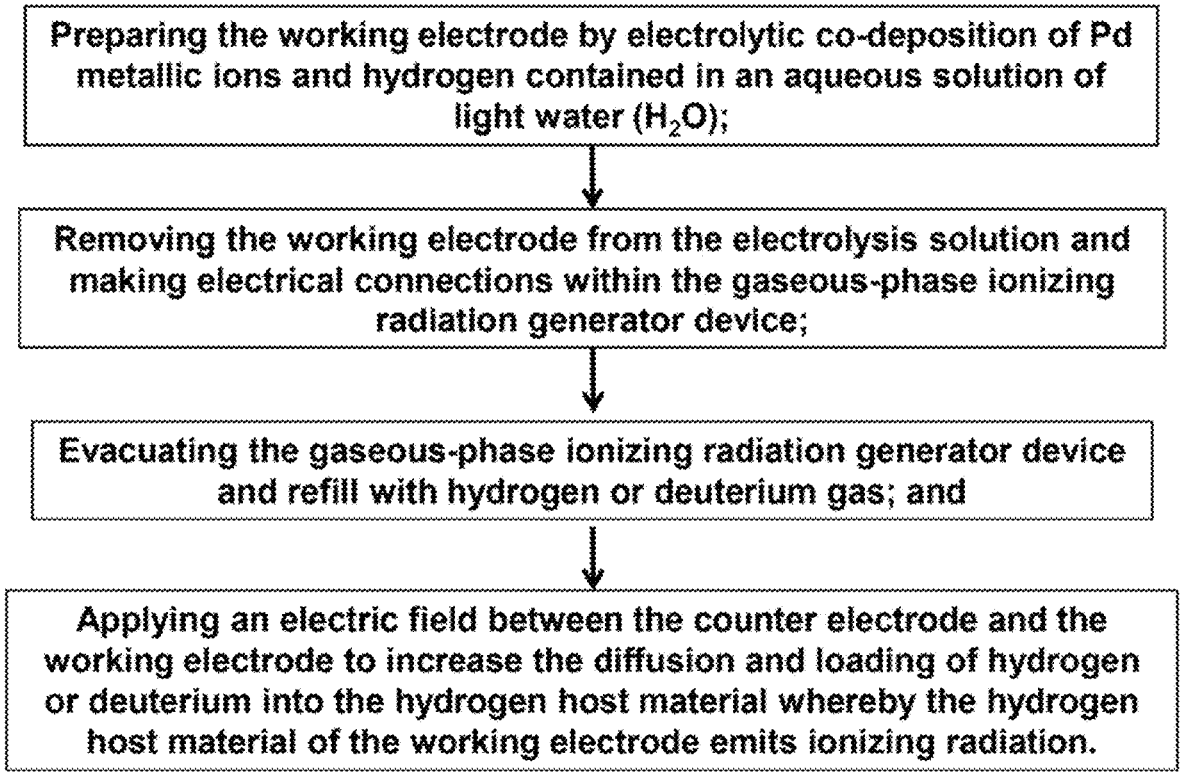
FIG. 13 illustrates a flow chart to describe the steps to prepare and activate a working electrode wherein ionizing radiation is produced.

FIG. 13 illustrates the primary steps used to prepare and activate the working electrode hydrogen host material for the gaseous-phase ionizing radiation generator. Multiple procedures are known for loading hydrogen into the lattice of hydrogen host materials such as palladium. Szpak et. J. Electroanal. Chem, 302 (1991) 255-260 published a method wherein codeposition occurred from a solution of 0.05 M PdCl and 0.3 M LiCl dissolved in a 99.9% pure $D_2O$ under potentiostatic control to produce a Pd metallic deuteride and U.S. Pat. No. 8,419,919 teaches co-deposition electrolysis wherein an aqueous bath of $D_2O$ containing 0.03 molar $PdCl_2$ and 0.3 molar LiCl deposits Pd onto the cathode in the presence of evolving $D_2$ gas resulting in Pd metallic deuteride. Another method to load and occlude hydrogen or deuterium into Pd to form a metallic hydride or deuteride was published by Szpak et. al. J Electroanal. Chem, 309 (1991) 273-292 which teaches Electrochemical Charging of Pd Rods.

Described herein is an improved technique wherein the aqueous electrolysis plating bath was light water ($H_2O$) and included 0.03 molar $PdCl_2$ and 0.3 molar LiCl. A ¼ inch copper tube that had been plated with a layer of silver was the cathode and a Pt wire was the anode for the electrolysis. The plating bath was cooled to 4° C. and a current was supplied to co-deposit the Pd and H forming hydrogen host material. After sufficient hydrogen host material is produced, the working electrode is removed from the liquid bath and physically and electrically assembled in the vessel being sure that the fittings are air tight. A vacuum is pulled to approximately −28" Hg after which the cell is refilled with $D_2$ gas. The final and possibly most critical step is the activation of the hydrogen host material at which point it produces ionizing radiation. This activation may be accomplished, if it does not occur spontaneously due to the pressure-induced diffusion of deuterium into the host material, by applying a current limited potential or voltage between the counter electrode and the working electrode. The resulting electric field may induce, by fugacity or cathodic hydrogen charging, an additional effective pressure to further diffuse deuterium into the working electrode's hydrogen host material, thus causing the hydrogen host material to become active by the production and emission of ionizing radiation.

Figure 14:
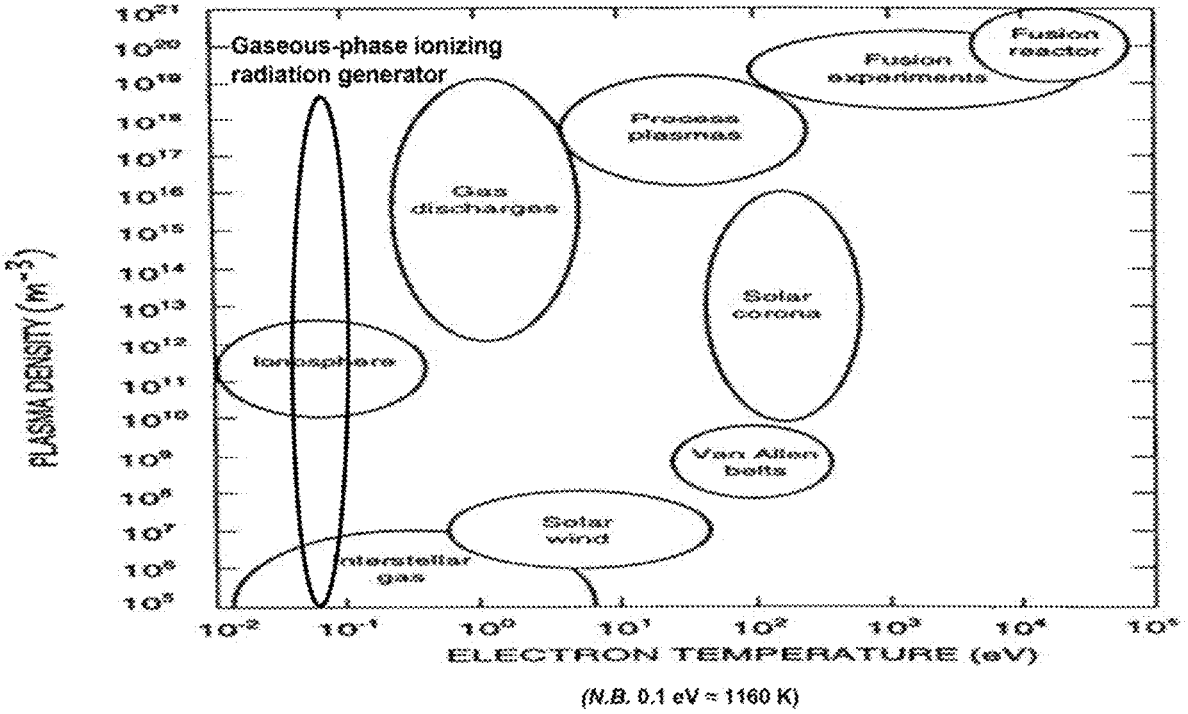
FIG. 14 illustrates the gaseous-phase ionizing radiation generator along with other known plasmas and sources.

FIG. 14 displays the estimated values of plasma density measured in ions per cubic meter for the variable current and voltage controlled gaseous-phase ionizing radiation generator using the experimentally measured currents and voltages shown in FIGS. 4 and 5. These, estimated plasma ion densities are plotted for comparison on a graph that presents other known types of plasmas. The ion densities for the gaseous-phase ionizing radiation generator have been estimated using equations presented in J J Thomson and G B Thomson's Conduction of Electricity Through Gases, 3$^{rd}$ edition book. The principles of conduction presented in this book are still correct today, although some of the measured values of physical constants such as the charge on the electron have been revised as the result of modern measurement techniques.

The invention claimed is:

1. A gaseous-phase ionizing radiation generation device comprising:

a gas or vapor or a combination thereof containing at least hydrogen including the isotopes and ions of hydrogen;

at least one counter-electrode and at least one working electrode, said working electrode being formed of a hydrogen host material;

a vessel to confine said gas or vapor, said vessel also containing said counter and working electrodes, said counter and working electrodes being physically separated from one another and positioned within the said vessel so as to lie in fluidic contact with said gas or vapor; and a source of electrical current or electrical potential in electrical contact with said counter and working electrodes, said electrical current or potential causing an electric field to be produced between said counter and working electrodes for causing the hydrogen ions contained in said gas or vapor to be transmitted toward said working electrode such that the hydrogen ions are diffused from said gas or vapor into and are occluded within the hydrogen host material of said working electrode, whereby ionizing radiation is produced by and emitted from said hydrogen host material so as to ionize said gas or vapor confined by the vessel.

2. The device of claim 1, wherein the vessel that confines said gas or vapor includes at least one port formed therein through which said gas or vapor flows into and out of said vessel.

3. The device of claim 2, wherein the at least one port of said vessel includes at least one valve to control the pressure and flow of said gas or vapor into and out of said vessel.

4. The device of claim 1, wherein the vessel that confines said gas or vapor is one of said at least one counter electrode or said at least one working electrode.

5. The device of claim 1, wherein the vessel that confines said gas or vapor includes at least one electrical feed-through to enable electrical connectivity into and out of said vessel between said source of electrical current or electrical potential and said counter and working electrodes.

6. The device of claim 1, wherein the hydrogen contained in the gas or vapor that is confined by said vessel includes deuterium.

7. The device of claim 1, wherein said source of electrical current or electrical potential is variable to control the flux of the ionizing radiation being produced and emitted by the hydrogen host material of said at least one working electrode.

8. The device of claim 1 wherein said vessel that confines said gas or vapor includes one or more sealable access openings that are sized to allow insertion and placement of said at least one working and counter electrodes within said vessel and to make electrical connections from said source of electric current or electrical potential to said electrodes by way of said access openings.

9. The device of claim 1, wherein the hydrogen host material of said at least one working electrode includes palladium.

10. The device of claim 1, further comprising a source of a magnetic field having a magnitude capable of permeating the hydrogen host material of said at least one working electrode.

11. The device of claim 1, further comprising a heater to heat said at least one working electrode.

12. The device of claim 1, wherein said at least one working electrode includes a low hydrogen permeable barrier that is capable of reducing the diffusion of the occluded hydrogen out of the hydrogen host material of said working electrode.

13. The device of claim 1, wherein the electric field produced between said at least one counter and said at least one working electrodes has a magnitude that is capable of reducing the diffusion of the occluded hydrogen out of the hydrogen host material of said working electrode.

14. The device of claim 1, wherein the vessel that confines said gas or vapor includes a material to produce neutrons in response to being impacted with alpha particles being emitted from said hydrogen host material of said at least one working electrode.

15. The device of claim 14, wherein the material to produce neutrons includes beryllium or alloys of beryllium.

16. The device of claim 1, wherein said at least one counter electrode has a fenestrated structure such that said electric field is produced between said counter electrode and the hydrogen host material of said at least one working electrode and the ionizing radiation passes through said counter electrode.

17. The device of claim 1, further comprising at least one additional electrode positioned within said vessel to collect the ionizing radiation and ions produced therefrom whereby the ions collected on the at least one additional electrode are capable of producing a voltage and current in response to being connected to a load impedance.

18. The device of claim 17, wherein said at least one additional electrode is comprised of a voltaic material that is adapted to produce an electrical potential and an electrical current in response to being impacted by particulate radiation or illuminated by electromagnetic radiation being emitted by said hydrogen host material.

19. The device of claim 1, further comprising at least two additional electrodes positioned within said vessel and comprised of materials that have respective work functions that differ from one another.

20. The device of claim 19, wherein said at least two additional electrodes are spaced from one another so that the gas or vapor in said vessel lying between said two additional electrodes is ionized to thereby create an electrical potential between said two additional electrodes.

21. The device of claim 20, further comprising a plurality of still further electrodes positioned in the vessel and comprised of materials that have respective work functions, wherein the electrodes of said plurality of still further electrodes that are comprised of identical work function material are electrically connected together.

22. The device of claim 1, wherein the vessel that confines said gas or vapor is comprised in part of the hydrogen host material from which said at least one working electrode is formed and wherein one side of the hydrogen host material forms the interior of the vessel that confines said gas or vapor and the opposite side of the hydrogen host material forms the exterior of the vessel.

23. The device of claim 22, wherein said at least one working electrode is hydrogen permeable.

24. The device of claim 22, wherein hydrogen is diffused into the hydrogen host material from the side of said host material that forms the interior of said vessel.

25. The device of claim 22, further comprising a fenestrated counter electrode positioned at the exterior of said vessel such that said fenestrated counter electrode creates an electric field with the at least one working electrode positioned in said vessel to prevent hydrogen from diffusing out of the hydrogen host material of said working electrode while allowing ionizing radiation to pass through said fenestrated counter electrode.

26. The device of claim 1, wherein the vessel that confines the gas or vapor is transparent to electromagnetic radiation or light at a different wavelengths.

27. The device of claim 1, wherein the interior of the vessel that confines the gas or vapor is coated with a florescent material.

28. A method for making the gaseous-phase ionizing radiation device recited in claim 1, comprising the steps of:

preparing the at least one working electrode by electrolytic co-deposition of palladium metallic ions and hydrogen contained in an aqueous solution of light water ($H_2O$);

removing the working electrode from the aqueous solution and making electrical connections between said working electrode within said vessel and said source of electrical current or electrical potential;

evacuating said vessel and refilling said vessel with hydrogen or deuterium gas; and applying the electric field between the at least one counter electrode and the at least one working electrode so as to control the diffusion and loading of hydrogen or deuterium from said gas thereof into the hydrogen host material whereby the hydrogen host material of the working electrode emits said ionizing radiation.

* * * * *